US010494927B2

(12) United States Patent
Haller

(10) Patent No.: US 10,494,927 B2
(45) Date of Patent: Dec. 3, 2019

(54) TURBINE ARRANGEMENT

(71) Applicant: ALSTOM Technology Ltd, Baden (CH)

(72) Inventor: Brian Robert Haller, Lincolnshire (GB)

(73) Assignee: General Electric Company, Schenectady, NY (US)

( * ) Notice: Subject to any disclaimer, the term of this patent is extended or adjusted under 35 U.S.C. 154(b) by 451 days.

(21) Appl. No.: 14/932,089

(22) Filed: Nov. 4, 2015

(65) Prior Publication Data

US 2016/0146013 A1 May 26, 2016

(30) Foreign Application Priority Data

Nov. 21, 2014 (EP) ..... 14194229

(51) Int. Cl.
*F01D 5/06* (2006.01)
*F01D 5/14* (2006.01)
*F01D 9/04* (2006.01)

(52) U.S. Cl.
CPC ..... *F01D 5/143* (2013.01); *F01D 5/06* (2013.01); *F01D 5/145* (2013.01); *F01D 9/041* (2013.01); *F05D 2220/31* (2013.01); *F05D 2220/3212* (2013.01); *F05D 2240/12* (2013.01); *F05D 2240/301* (2013.01); *F05D 2240/307* (2013.01)

(58) Field of Classification Search
CPC . F01D 5/06; F01D 5/143; F01D 5/145; F01D 5/147; F01D 9/041
See application file for complete search history.

(56) References Cited

U.S. PATENT DOCUMENTS

| | | | | |
|---|---|---|---|---|
| 2,392,673 | A * | 1/1946 | Hans Kraft | F01D 5/142 415/192 |
| 4,371,311 | A | 2/1983 | Walsh | |
| 4,460,309 | A | 7/1984 | Walsh | |
| 6,375,420 | B1 | 4/2002 | Tanuma et al. | |
| 6,752,589 | B2 * | 6/2004 | Vogan | F01D 25/24 29/888.021 |
| 6,769,869 | B2 * | 8/2004 | Tanuma | F01D 5/141 415/199.5 |
| 8,894,363 | B2 | 11/2014 | Haller | |
| 2006/0127214 | A1 | 6/2006 | Glasspoole | |
| 2012/0027568 | A1 | 2/2012 | Haller | |
| 2012/0183411 | A1 * | 7/2012 | Haller | F01D 9/041 416/243 |

FOREIGN PATENT DOCUMENTS

| | | |
|---|---|---|
| EP | 0 894 945 A2 | 2/1999 |
| EP | 1 227 217 A2 | 7/2002 |
| EP | 2 479 381 A1 | 7/2012 |
| JP | S51-77702 A | 7/1976 |

* cited by examiner

*Primary Examiner* — Dwayne J White
*Assistant Examiner* — Maxime M Adjagbe
(74) *Attorney, Agent, or Firm* — Frank A. Landgraff; Charlotte C. Wilson; James W. Pemrick

(57) ABSTRACT

The invention relates to a turbine for generating work by a stagewise expansion of a gas, such as steam wherein a downstream stage guide average height is less than an adjacent upstream stage runner average height.

10 Claims, 2 Drawing Sheets

TURBINE ARRANGEMENT

CROSS-REFERENCE TO RELATED APPLICATIONS

This application claims priority to European Patent Application 14194229.2 filed Nov. 21, 2014, the contents of which are hereby incorporated in its entirety.

TECHNICAL FIELD

The present disclosure relates to arrangements and configurations of multi stage gas turbines and steam turbines.

BACKGROUND

A common objective of turbine manufacturers, whether it be manufacturers of steam turbine or gas turbines, is the improvement of efficiency. This can be achieved by reducing leakages, optimising the degree of stage reaction, blade aspect ratio, stage loading and blade configuration, including the application of 3D stacking, twisting, bowing and lean. Nonetheless, there is a continued need to seek new opportunities to improve turbine efficiency.

SUMMARY

Provided is a turbine with an arrangement that can provide improved efficiency, in particularly for turbines configured for low volumetric flow applications with low root reaction.

It attempts to address this problem by means of the subject matters of the independent claim. Advantageous embodiments are given in the dependent claims.

The disclosure is based on the general idea of providing an oscillating flow annulus in which guides of reduced heights are used thereby creating a step in the flow annulus at selected turbine axial stages.

One general aspect includes a turbine for generating work by a stagewise expansion of a gas, wherein the turbine has an axial direction corresponding to an expansion flow of the gas and a radial direction. The turbine comprises a casing inner surface, a hub, a first axial stage and a second axial stage. The first axial stage includes a first guide fixed to the casing inner surface and a first runner fixed to the hub downstream of the first guide. The first runner also includes a first runner tip radially distal from the hub and a first runner average radial height between the first runner tip and the hub along an axial midpoint of the first runner. The second axial stage, downstream of the first axial stage, includes a second guide fixed to the casing inner surface and having a second guide tip distal from the casing inner surface and a second guide average radial height between the second guide tip and the casing inner surface along an axial midpoint of the second guide. The second axial stage further includes a second runner fixed to the hub downstream of the second guide. The turbine is configured such that the second guide average height is less than the first runner average height. This imparts the turbine with an oscillating annulus.

Further aspects may include one or more of the following features. A hub diameter in a region extending between and including the first guide and the second runner that is constant. A hub radius in a region extending between and including the first guide and the second runner that is variable such that the hub radius both increases and decreases. A first runner radial height between the hub and the first runner tip that increases along the axial direction such that a hade angle formed by of the first runner tip is constant along the axial direction. A second runner radial height that increases along the axial direction such that a hade angle form by the second runner tip is constant along the axial direction. The first guide, along the casing inner surface in the axial direction, forming a bellmouth shape and the second guide, along the casing inner surface in the axial direction, forming a bellmouth shape. A first guide radial height between the casing inner surface and the first guide tip that decreases along the axial direction such that the first guide tip forms a bellmouth shape along the axial direction. A second guide radial height between the casing inner surface and the second guide tip decreases along the axial direction such that the first guide tip forms a bellmouth shape along the axial direction. A K value of the first runner that varies from 0.25 at the hub to 0.16 at the first runner tip. A K value of the second guide that varies from 0.15 at casing inner surface to 0.25 at the second guide tip.

The turbine may also be a steam turbine which includes one or more of the following features. A root reaction of 30%. A back surface deflection of the first runner, the second runner or both the first runner and the second runner between 25 degree and 35 degrees. A disc circumferential speed at the hub and a velocity equivalent of stage isentropic total to status heat drop lies in a range of 0.5 to 0.56. A ratio of a second guide tip radius to a hub radius is less than 1.3.

The turbine may also be a gas turbine with a back surface deflection of the first runner and/or the second runner of between 25 degrees and 30 degrees.

Other aspects and advantages of the present disclosure will become apparent from the following description, taken in connection with the accompanying drawings which by way of example illustrate exemplary embodiments of the present invention.

BRIEF DESCRIPTION OF THE DRAWINGS

By way of example, an embodiment of the present disclosure is described more fully hereinafter with reference to the accompanying drawings, in which.

DETAILED DESCRIPTION

Figure 1:
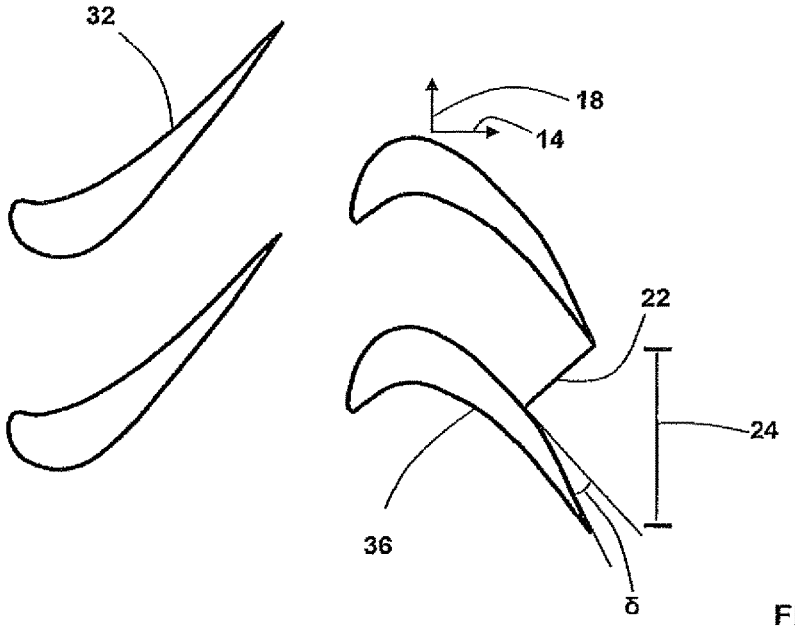
FIG. 1 is a top view of a turbine axial stage.

Exemplary embodiments of the present disclosure are now described with references to the drawings, wherein like reference numerals are used to refer to like elements throughout. In the following description, for purposes of explanation, numerous specific details are set forth to provide a thorough understanding of the disclosure. However, the present disclosure may be practiced without these specific details, and is not limited to the exemplary embodiment disclosed herein.

Figure 2:
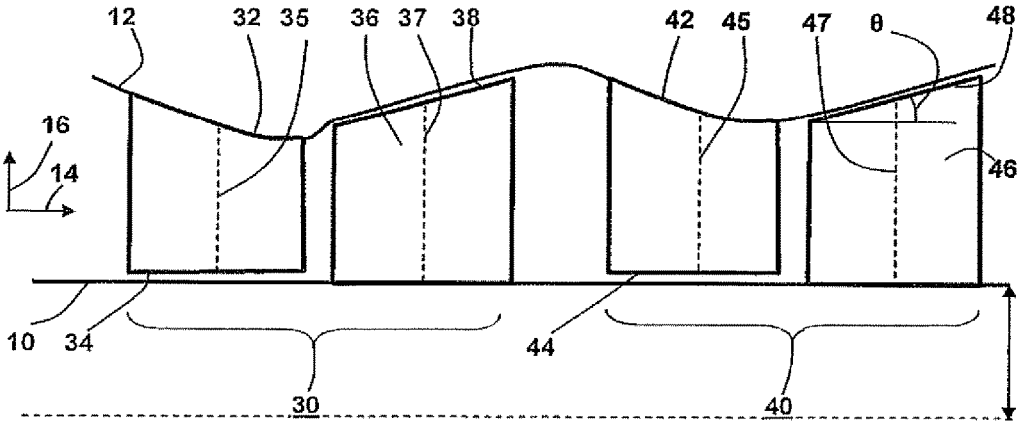
FIG. 2 is a side view of adjacent turbine axial stages to which exemplary embodiments are applied.

FIG. 2 shows a turbine axial stage 30, 40 to which exemplary embodiments of the invention can be applied. The turbine axial stage includes guides 32 distributed in a circumferential direction and downstream runners 36 distributed in a circumferential direction. As shown in FIG. 1, the guides 32 and runners 42 have a pitch 24, a throat 22 and a back surface deflection angle δ wherein, the pitch 24 is defined as the distance in the circumferential direction between corresponding points on adjacent guides 32 and adjacent runners 42, the throat 22 is defined as the shortest distance between surfaces of adjacent guides 32 and adjacent runners 42, and the back surface deflection angle δ is defined as the 'uncovered turning', that is the change in angle between suction surface throat point and suction surface trailing edge blend point.

In an exemplary, as shown in FIG. 2 and applied to a turbine for generating work by the stagewise expansion of a gas, the turbine has an axial direction 14 corresponding to an expansion flow of the gas and a radial direction 16. The turbine has a casing inner surface 12 and a hub 10. Between the casing inner surface 12 and hub 10 are a plurality of turbine axial stages. Each axial stage includes a guide 32, 42 fixed to the casing inner surface 12 while each guide 32, 42 has a guide tip 34, 44 that is distal from the casing inner surface 12 wherein at an axial midpoint of each guide 32, 42 the distance between the casing inner surface 12 and the guide tip 34, 44 defines an average guide height 35, 45.

Adjacent and downstream of each guide 32, 42 is a runner 36, 46 fixed to the hub 10. Each runner 36, 46 has a runner tip 38, 48 that is distal from the hub 10 wherein at an axial midpoint of each runner 36, 46 the distance between hub 10 and the runner tip 38, 48 defines an average runner height 37, 47.

As shown in FIG. 1, in an exemplary embodiment the second guide average height 45 is less than the first runner average height 37. This creates a waved/stepped casing inner surface 12 while the hub 10 remains essential straight.

In an exemplary embodiment shown in FIG. 2 in the axial direction along the casing inner surface in the axial direction, the guide 32, 42 forms a bellmouth shape.

In a not shown exemplary embodiment in the axial direction along the guide tips, 34, 44, the guide tips 34, 44 form a bellmouth shape.

In an exemplary embodiment shown in FIG. 1, the hade angle θ, defined as flare angle of the tip of a runner 36, 46, is constant in the axial direction 14.

Figure 3:
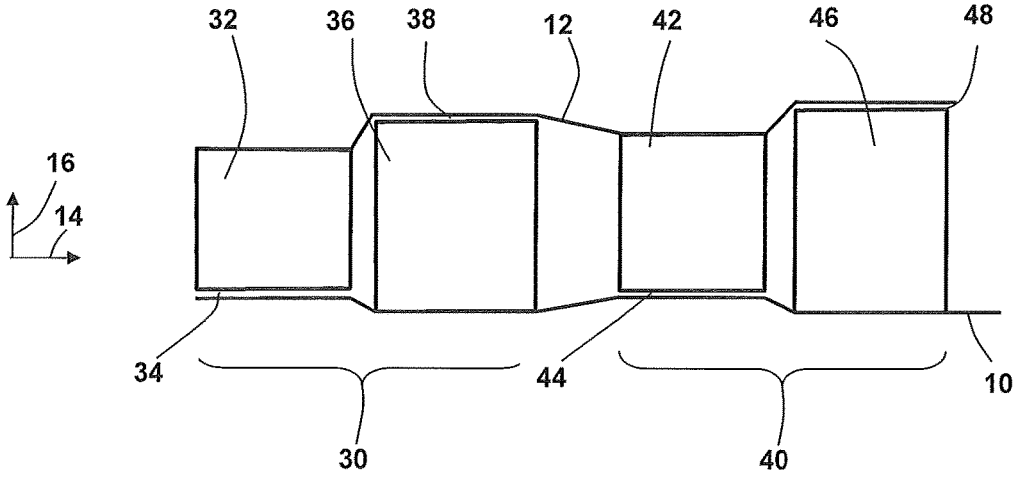
FIG. 3 is a side view of adjacent turbine axial stages to which another exemplary embodiment is applied.

In another exemplary embodiment shown in FIG. 3, where the second guide average height 45 is less than the first runner average height 37, both the casing inner surface 12 and the hub have a wave/step shape. In this way, in the region between and including the first axial stage 30 and second axial stage 40, the hub radius both increases and decreases.

In an exemplary embodiment, the K value of the runner 36, 46, defined as a ratio of the throat 22 to pitch 24, varies from 0.25 at the hub to 0.16 at the runner tip 38, 48.

In an exemplary embodiment, the K value of the runner 36, 46, defined as a ratio of the throat 22 to pitch 24, varies from 0.15 at casing inner surface to 0.25 at the guide tip 34, 44.

In an exemplary embodiment a ratio of a second guide tip radius to a hub radius is less than 1.3.

Due to differences between gas turbine and steam turbines, application of a waved/stepped casing inner surface 12 of exemplary embodiments may require difference configurations for the two types of turbines.

In an exemplary embodiment applied to a steam turbine either the first axial stage 30, the second axial stage 40 or both the first axial stage 30 and second axial stage 40 are configured to have a root reaction of around 30%. In a further exemplary embodiment the steam turbine has a back surface deflection δ of the runner 36, 46 of between 25 degree and 35 degrees to reduce losses. It may further be configured such that in normal operation a ratio of a disc circumferential speed at the hub Ur and a velocity equivalent of stage isentropic total to status heat drop $C_0$ lies in the range of 0.5 to 0.56.

In an exemplary embodiment applied to a gas turbine a back surface deflection of the first runner and/or the second runner is between 25 degrees and 30 degrees.

Although the disclosure has been herein shown and described in what is conceived to be the most practical exemplary embodiments, the present disclosure can be embodied in other specific forms. The presently disclosed embodiments are therefore considered in all respects to be illustrative and not restricted. The scope of the disclosure is indicated by the appended claims rather that the foregoing description and all changes that come within the meaning and range and equivalences thereof are intended to be embraced therein.

The invention claimed is:

1. A turbine for generating work by a stagewise expansion of a gas, the turbine having an axial direction corresponding to an expansion flow of the gas and a radial direction, the turbine further comprising:

a casing inner surface;

a hub, a first axial stage including:

a first guide fixed to the casing inner surface:

a first runner fixed to the hub downstream of the first guide, having:

a first runner tip radially distal from the hub, a first runner average radial height between the first runner tip and the hub along an axial midpoint of the first runner;

a second axial stage, downstream of the first axial stage, including:

a second guide, fixed to the casing inner surface, having;

a second guide tip distal from the casing inner surface;

a second guide average radial height between the second guide tip and the casing inner surface along an axial midpoint of the second guide; and a second runner, fixed to the hub downstream of the second guide, wherein the second guide average height is less than the first runner average height.

2. The turbine of claim 1, wherein the hub has a hub radius-which is constant in a region extending between and including the first guide and the second runner.

3. The turbine of claim 1, wherein the hub has a hub radius which is variable in a region extending between and including the first guide and the second runner such that the hub radius both increases and decreases.

4. The turbine of claim 1 further comprising:

a second runner tip radially distal from the hub, wherein:

a first runner radial height between the hub and the first runner tip increases along the axial direction such that a hade angle formed by the first runner tip is constant along the axial direction; and a second runner radial height increases along the axial direction such that a hade angle formed by the second runner tip is constant along the axial direction.

5. The turbine of claim 1, wherein the first guide, along the casing inner surface in the axial direction, forms a bellmouth shape and the second guide, along the casing inner surface in the axial direction, forms a bellmouth shape.

6. The turbine of claim 1, further comprising:

a first guide tip distal from the casing inner surface, wherein:

a first guide radial height, between the casing inner surface and the first guide tip, decreases along the axial direction; and a second guide radial height between the casing inner surface and the second guide tip decreases along the axial direction.

7. The turbine of claim 1 wherein a K value of the first runner varies from 0.25 at the hub to 0.16 at the first runner tip.

8. The turbine of claim 1, wherein a K value of the second guide varies from 0.15 at casing inner surface to 0.25 at the second guide tip.

9. The turbine of claim 1, wherein a back surface deflection of the first runner, the second runner, or both the first runner and the second runner is between 25 degree and 35 degrees.

10. The turbine of claim 1, wherein the turbine is a gas turbine and a back surface deflection of the first runner and/or the second runner is between 25 degrees and 30 degrees.

* * * * *